United States Patent [19]

Merdic

[11] Patent Number: 4,723,822

[45] Date of Patent: Feb. 9, 1988

[54] SAFETY UTILITY EXTENSION CORD

[76] Inventor: Louis A. Merdic, 1110 Wilshire Dr., Youngstown, Ohio 44511

[21] Appl. No.: 905,961

[22] Filed: Sep. 11, 1986

[51] Int. Cl.[4] ..... H01R 11/00

[52] U.S. Cl. ..... 439/502; 174/136

[58] Field of Search ..... 174/136; 339/28, 213 R

[56] References Cited

U.S. PATENT DOCUMENTS

| | | | |
|---|---|---|---|
| 738,250 | 9/1903 | Stanley | 174/136 |
| 2,275,019 | 3/1942 | Peterson | 174/42 |
| 2,386,000 | 10/1945 | McQueston | 339/213 R |
| 3,249,679 | 5/1966 | Bogese | 174/5 |

FOREIGN PATENT DOCUMENTS

| | | | |
|---|---|---|---|
| 3133532 | 3/1983 | Fed. Rep. of Germany | 339/28 |

*Primary Examiner*—Gil Weidenfeld
*Assistant Examiner*—Paula A. Austin
*Attorney, Agent, or Firm*—Harpman & Harpman

[57] ABSTRACT

A safety extension cord for use with power garden equipment to prevent accidental cutting of the cord. The safety extension cord has an adjustable enlarged diameter section adjacent one end and a retaining clip to secure the cord to the power garden equipment for preventing accidental disconnection.

3 Claims, 6 Drawing Figures

SAFETY UTILITY EXTENSION CORD

BACKGROUND OF THE INVENTION

1. Technical Field

This invention relates to an electrical power cord used with garden tools, such as hedge trimmers and the like which require a long cord to connect the tool to an electrical outlet. The long power cord is often exposed to accidental cutting during the use of the tools during operation.

2. Description of Prior Art

Prior Art devices of this type have all relied on heavy insulated covered cord bodies with modular plug and socket ends. Such cords are usually of similar or same dimension over their entire length between the ends. Other examples of protective covers can be seen in U.S. Pat. No. 3,249,679 and U.S. Pat. No. 2,275,019.

In U.S. Pat. No. 3,249,679 a protective covering is shown having a spiral configuration that can be wrapped around guy wires used to support telephone poles.

In U.S. Pat. No. 2,275,019 a cable reinforcement device is disclosed which is split and positioned over a cable for the reduction of stress to the main cable.

SUMMARY OF THE INVENTION

A safety extension cord to be used with hand-held electrical power garden tools that provides a positive attachment of the cord to the tool and an area of increased cord diameter adjustably positioned on the cord adjacent the tool end. The cord is adjustable and can be positioned anywhere along the length of the cord and locked in that position by independently adjustable end retaining devices.

DESCRIPTION OF THE PREFERRED EMBODIMENT

A safety extension cord for use with electrical powered hand tools used in the home environment, such as hedge trimmers, comprises a main electrical power cord having typically two conductive shielded wires W and a ground wire G within an elongated molded plastic body 10 of a given outside diameter.

Figure 1:
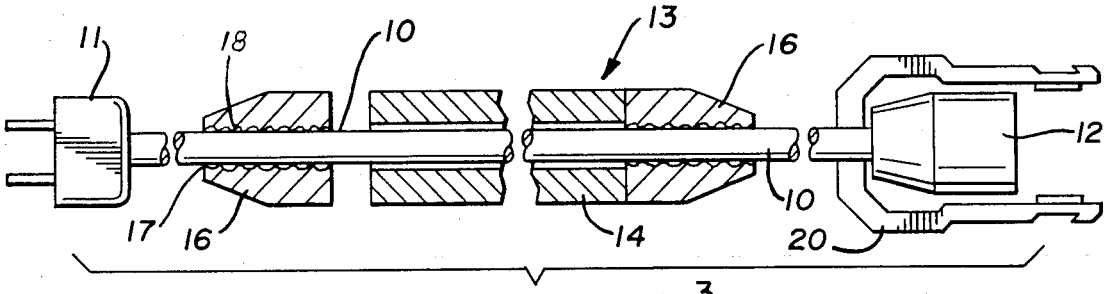
FIG. 1 is a cross section side plan view of the safety cord.

The cord has the usual male plug end 11, and a female socket end 12 for use in a normal home grounded electrical outlet (not shown). Referring now to FIGS. 1 ∝ 5 of the drawings, an adjustable cord protection sheath assembly 13 can be seen positioned on a portion of the molded plastic body 10. The protection sheath assembly 13 comprises an enlarged elongated hollow synthetic body member 14. The inner diameter of the synthetic body member 14 is greater than the outside diameter of said molded plastic body 10, allowing the synthetic body member 14 to slide freely thereover.

A pair of oppositely disposed sheath blocks 16 are positioned on the molded plastic body 10 at either end of said synthetic body member 14 and are of a tapered ended cylindrical configuration having a central opening at 17. A plurality of internal ribs 18 extend transversely within the opening at 17 each of which ribs are of a diameter slightly less than that of said molded plastic body 10 given outside diameter and accordingly will hold firmly thereon once positioned by the user.

Figure 3:
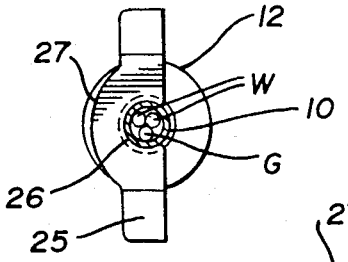
FIG. 3 is a cross-sectional view on lines 3—3 of FIG. 2 of the drawings.
Figure 2:
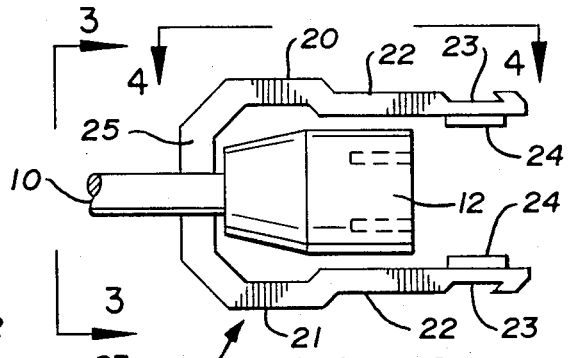
FIG. 2 is an enlarged plan view of a tool engagement fitting on one end of the safety cord.
Figure 4:
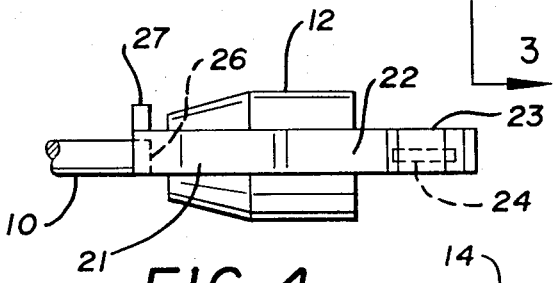
FIG. 4 is a side plan view on lines 4—4 of FIG. 2 of the drawings.

Referring now to FIGS. 2, 3, and 4 of the drawings, a restraint clip 19 can be seen positioned on the female socket end 12 of the molded plastic body 10. The restraint clip 19 has a generally u-shaped configuration with oppositely disposed outwardly extending arms 20 and 21. Each arm has an offset portion 22 with a recessed area 23 inwardly from its free end. A tab 24 is positioned on each arm opposite said recessed area 23 and defines in combination with the offset portion 22 an interlocking combination compatible with the power plug and case on a variety of common commercially available hedge trimmers. An integral arm interconnection member 25, best seen in FIGS. 3 and 4 of the drawings, has a semicircular notch 26 within one area of increased transverse dimension at 27 midway between the arms 20 and 21.

In operation the molded plastic body 10 adjacent the female plug end 12 is frictionally engaged within the notch 26 with the arms 20 and 21 of the retaining clip 19 and interconnection member 25 extending around the female end plug 12.

Figure 5:
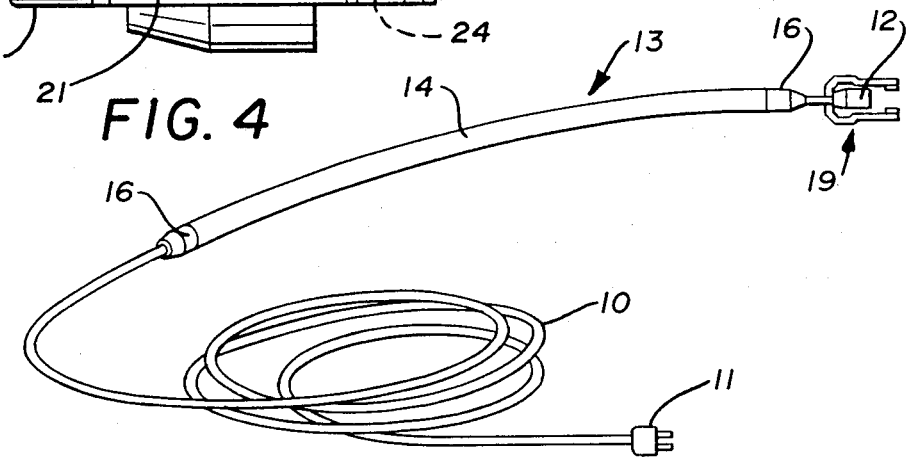
FIG. 5 is a perspective view of the safety cord.

Referring to FIG. 5 of the drawings, the safety extension cord of the invention can be seen as having a protection sheath 13 positioned on the molded plastic body 10 adjacent to and extending from the restraint clip 19 between the sheath blocks 16. The synthetic body member 14 is rotatable around the longitudinal axis of the cord and effectively increases the overall outer diameter of the molded plastic body 10.

Figure 6:
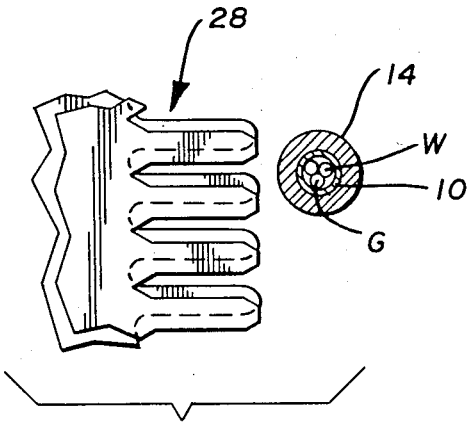
FIG. 6 is an enlarged representation of a portion of a hedge trimming blade and a sectional view of the enlarged section of the safety cord.

If will be evident from the above description that the increased cord size is advantageous in protecting the molded plastic cord body 10 from accidental cuts and severs when the same is accidentally engaged in the hedge trimmers, as best seen in FIG. 6 of the drawings. A portion of a multiple cutting bar assembly 28 is shown in relation to the effective increase of the outer diameter of the molded plastic body 10 by the inclusion of the synthetic body member 14, thus preventing accidental cutting of the safety cord.

The retainer clip 19 prevents accidental disconnection of the safety cord from the hedge trimmers, which is relatively common when using outdoor power tools with long cords.

Thus, it will be seen that a new and useful safety extension cord has been illustrated and described and it will be apparent to those skilled in the art that the various changes and modifications may be made therein without departing from the spirit of the invention.

Therefore I claim:

1. An improvement to a power extension cord for use with portable power equipment, said cord comprises at least a pair of conductive wires, a non-conductive outer body, a male plug end, and a female plug end interconnected to said conductive wires, said improvement comprising a protection sheath assembly of a diameter greater than that of said power extension cord, said sheath assembly comprising an elongated synthetic body member freely rotatable on said power extension cord and means for adjustably securing said elongated synthetic body member on said power extension cord, and means for retaining said female plug end to said power equipment.

2. The improvement to a power extension cord of claim 1 wherein said means for adjustably securing said elongated synthetic body member comprises sheath blocks including tapered-ended, apertured, cylindrical members with a plurality of internal ribs transversely positioned within said tapered-ended, apertured, cylindrical members.

3. The improvement to a power extension cord of claim 1 wherein said means for retaining said female plug end to said power equipment comprises a retention clip having interconnected outwardly extending, oppositely disposed arms.

* * * * *